United States Patent [19]

Martin

[11] Patent Number: 5,019,183

[45] Date of Patent: May 28, 1991

[54] PROCESS FOR ENHANCING PHYSICAL PROPERTIES OF ALUMINUM-LITHIUM WORKPIECES

[75] Inventor: Gardner R. Martin, Redondo Beach, Calif.

[73] Assignee: Rockwell International Corporation, El Segundo, Calif.

[21] Appl. No.: 411,967

[22] Filed: Sep. 25, 1989

[51] Int. Cl.[5] ..... C22F 1/04

[52] U.S. Cl. ..... 148/12.7 A; 148/415; 420/902

[58] Field of Search ..... 148/2, 12.7 A, 415; 420/902

[56] References Cited

U.S. PATENT DOCUMENTS 4,571,272 2/1986 Grimes ..... 420/902

*Primary Examiner*—R. Dean

*Attorney, Agent, or Firm*—Charles T. Silberberg; Harold C. Weston; Lawrence N. Ginsberg

[57] ABSTRACT

A process for enhancing the physical properties of superplastically formed and solution heat treated Aluminum-Lithium workpieces entails stretching near-net parts by from 2 to 10 percent at a specified temperature, followed by controlled aging.

25 Claims, 1 Drawing Sheet

FIG. 1(a)
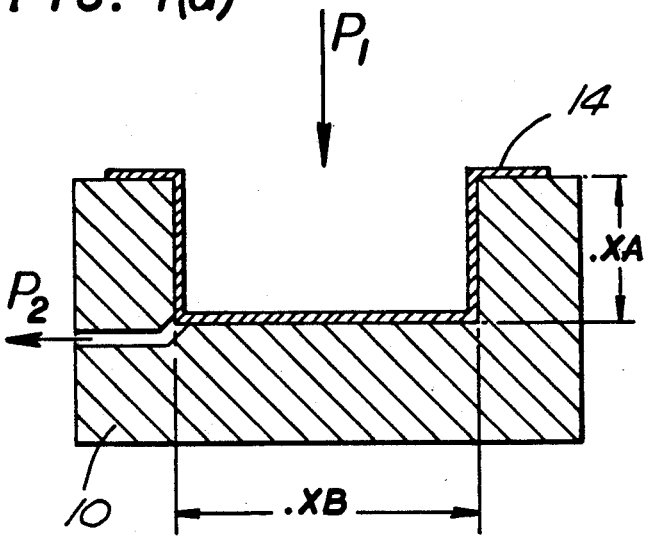
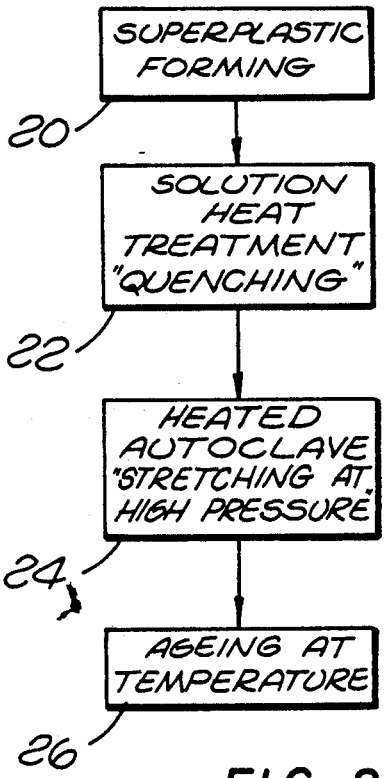
FIG. 2
FIG. 1(b)
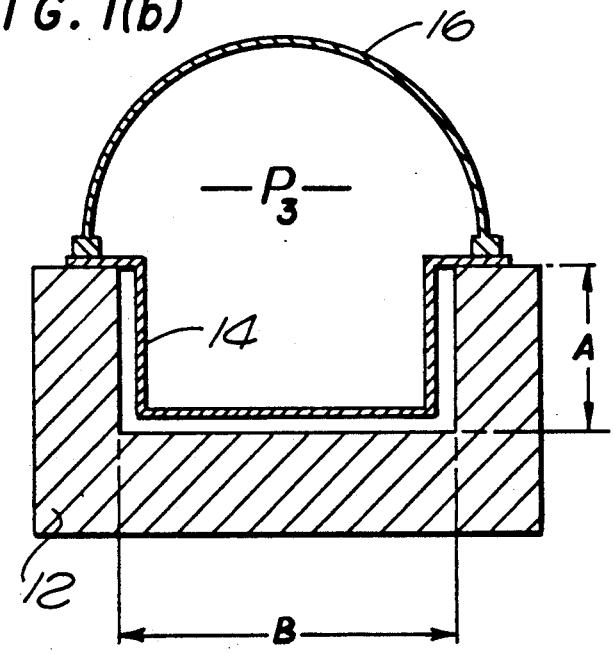

PROCESS FOR ENHANCING PHYSICAL PROPERTIES OF ALUMINUM-LITHIUM WORKPIECES

This invention was made with Government support under Air Force Contract No. F33615-87-C-3223. The United States Government has certain rights in this invention.

BACKGROUND OF THE INVENTION

1. Field of the Invention

This invention relates to superplastically formed Aluminum Lithium workpieces and more particularly to a process for thermo-mechanically conditioning such workpieces so that their yield strength and other physical properties are improved by up to 10 percent over those of unconditioned references. The process presented here concerns itself with parts made of Aluminum-Lithium through conventional superplastic forming techniques, but conditioning processes specified are applicable to parts made from other fine grain Aluminum-Lithium alloys including those with solutes of copper and magnesium, provided proper modifications to temperatures, times and pressures are made.

Aluminum-Lithium sheet stock, as provided by commercial mills, is preconditioned by mill processes to provide a variety of specifications on hardness, tensile strengths and ductility. When such preconditioned stock is used for fabrication of parts though superplastic forming procedures, significant enhancement of these parameters is possible. Specifically, when such parts are thermo-mechanically conditioned by quenching, stretching and aging, they show mechanical properties and physical characteristics significantly superior to those of unconditioned parts. It should be noted that both conditioned and unconditioned Aluminum-Lithium workpieces possess mechanical properties and physical characteristics superior to those of conventional aluminum parts at weight savings of up to 10 percent and at similar increases in stiffness.

2. Description of the Prior Art

Commercially produced Aluminum-Lithium alloys contain about 3% Lithium by weight with Lithium atoms and compounds being disposed relatively uniformly throughout the aluminum matrix. Uniformity of crystalline structure in mill standard Aluminun-Lithium stock is intentionally distorted by mill processes to provided precipitation loci throughout the metal matrix, at which loci, increased resistance to laminar shear is created. A variety of atomic-molecular activity also results from these processes which produces strained lattice structures and serendipitous increases in yield strengths, certain toughness parameters and other mechanical properties. Stresses induced in the alloy result in dislocation sites where subsequent precipitation of Aluminum-Lithium compounds can occur. Conditions for optimal precipitation and associated strengthening of Aluminum-Lithium alloys are well understood and employed by those skilled in this art.

Needs of commerce and industry for lightweight, tough, high stress tolerant parts and products has lead to intense research into Aluminum-Lithium alloys, and a compendium of this technology is available in the open literature. Some examples of such are found in papers presented at the Second International Aluminum-Lithium conference of the Metallurgical Society of the American Institute of Mechanical Engineers, Conference Proceedings, Apr. 12–14, 1983 (Library of Congress #83-83124 and ISBN #0-89520-472-X).

Conventional processes used for creation of superplastically formed parts of Aluminum-Lithium utilize associated technology and, while that technology is not presented as directly applicable to the within process, it is germane to production of preforms suitable to conditioning thereby. Commercially produced Aluminum-Lithium alloys containing major alloying elements of copper or magnesium, or combinations of the same, are also suitable for use with workpieces processed per this disclosure.

SUMMARY OF THE INVENTION

In accordance with the present invention, a near-net workpiece of superplastically formed Aluminum-Lithium sheet is solution heat treated, quenched and stretched to final part configuration, followed by aging. As used in this disclosure, "near-net" shall refer to the dimensions of a superplastically formed part (viz. "workpiece") which are from 2 to 10 percent smaller, or less, than those of the desired end product, or "final dimensions." The inventive aspect of this disclosure resides in its stretching the "near-net" part to its final dimensions with remarkable enhancement of its physical properties resulting from the stretching and subsequent aging. Specifically, after quenching from its superplastic temperature, the near-net piece is positioned in a final configuration die and sealed in an autoclave. It is then heated to a working temperature of approximately one third that used for its superplastic forming and, after being sealed around its periphery to a die shaped to uniformly greater dimensions, "final dimensions", it is subjected to a high pressure of 10,000 to 20,000 PSI. This pressure forces the workpiece to conform with the net die by stretching it uniformly over the die's inner surfaces, increasing its size, accordingly, to the net configuration, i.e. "final dimensions".

Pressure may then be removed and the fully formed workpiece allowed to age at atmospheric pressure in a specified temperature environment. Optionally, the workpiece may be retained in the autoclave and aged there for the required period. It is during this aging process that final characteristics of the workpiece develop and stabilize.

Because Lithium atoms tend to migrate (i.e. diffuse) to free surfaces and, there, react with oxygen, it is preferable to minimize workpiece exposure to high temperatures. Inert atmospheres of nitrogen, helium or other benign gas will reduce Lithium loss (to Lithium oxide) from the workpiece and are desirable for all operations at high temperature. Optimal length and temperature of the aging cycle is related to the particular alloy used and is determined experimentally for the materials and workpieces described in the preferred embodiment hereof.

Principal object of this invention is provision of a thermo-mechanical process to enhance mechanical properties of superplastically formed Aluminum-Lithium workpieces through use of a stretch forming operation coupled with controlled aging of the stretched part.

Fine grain Aluminum-Lithium (Al-Li), and certain other materials, exhibits strength to weight ratios and formability traits that make it particularly attractive for weight critical applications such as those for structure and components of aerospace systems. Formability characteristics of interest are its adaptability to superplastic forming and straightforward post-forming procedures which provide strength enhancement through solution heat treatment, controlled stretching and aging. Superplasticity of Al-Li allows precise shaping of componentry by dies or molds, reducing labor intensive fabrication work and costs. Physical and mechanical characteristics meeting or exceeding those of conventional aluminum alloy parts, plus a combination of weight and stiffness advantages, give superplastically formed Al-Li parts and structures preferred consideration for many aerospace applications.

Although superplasticity is a mature art and its advantages and features are well documented, prior to this invention, no process has been reported which allows the enhancement of mechanical properties of superplastically shaped parts. Absent such a process, these parts have been deprived of appreciable fractions of their possible maximum demand usage.

By fabricating an SPF part to between 90 and 98 percent of its final form dimensions, followed by quenching, such a part is ready for the critical strength enhancement sequence of this invention. The undersized part is sealed to a forming die which conforms to final dimension requirements, placed in a heated autoclave and high pressure exerted on the part to mechanically stretch it to its final shape. When such a shaping is complete, the part is aged in a controlled environment for a determined period prior to release for use.

A simplified presentation of the process and equipments required is presented in the attached drawings.

BRIEF DESCRIPTION OF THE DRAWINGS

FIG. 1 is a schematic presentation of equipments used in the disclosed process.

FIG. 2 is a block diagram of process flow functions.

DETAILED DESCRIPTION OF PREFERRED EMBODIMENT

With reference to FIG. 1, a preform of Al-Li is produced from a blank of sheet stock by shaping it through such shaping means as die 10, with conventional temperatures and pressures. The preform is heated to a temperature in its SPF range (in the case of Al-Li, a range of 950 to 1050 degrees F. works well) and forming pressure exerted on its inner face with back pressure on the forming face thereof. Forming pressures of approximately 450 PSI and back pressures of approximately 400 PSI have been used successfully for first stage fabrication per block 20 of FIG. 2.

While FIGS. 1(*a*) and (*b*) show female dies 10, 12 for both block 20 and block 24 operations, it is not critical to the invention that this be so in practice. Workpiece 14 may be shaped by other means such as a male mold in block 20, at the same subscale dimensions called for by the dimensions A, B, of FIGS. 1(*a*),(*b*). Dimensions A, B of FIGS. 1(*a*), (*b*) merely imply relative dimensions. Die 12 is larger, by a factor of from 2 to 10 percent, than die 10. .XA and .XB of FIG. 1 indicate this difference in size between dies 10 and 12, so that X ranges between 98 and 90. In block 24 operations, stretching of workpiece 14 to final dimensions can be controlled most readily by use of a female die 12 with loose control over the high autoclave pressures.

With workpiece 14 at its high formation temperature (block 20), it is removed from formation die 10 and solution heat treated (block 22) by quenching in a suitable fluid. Fluid used in block 22 conditioning may be water, glycol or any other high transference medium.

To minimize time of hot press usage, and for ease of handling during solution heat treatment, means such as die liners may be used to support workpiece 14 during solution heat treatment. Such die liners as stainless steel molds or forms have been disclosed in U.S. patent application Ser. No. 909,545 by F. T. McQuilken, assigned to assignee of this application. Workpiece 14, after quenching, is readily handled and sealed into die 12 in autoclave 16 through conventional processes.

When workpiece 14 has been formed and heat treated by quenching, block 22, it is sealed into autoclave 16 and raised to an aging temperature of approximately 350° F. At this temperature, high pressure of between 10,000 and 20,000 psi is admitted to the autoclave. Pressure applied stretches workpiece 14 from its near-net or subscale dimensions of block 20 to the final dimensions of die 12 and aging block 26.

Dies 10 and 12 are cooperative in that die 10 shapes workpiece 14 to approximately 90–98% of its final form. Female die 12 is built to final dimensions to which workpiece 14 is stretched by pressures applied in block 24.

Sealing of workpiece 14 to die 12 in autoclave 16 is accomplished with conventional means not part of this invention.

Time between solution treatment, block 22, and mechanical stretching in autoclave 16, block 24, is an important element in the strength enhancement process. Internal thermo-mechanical stresses in the alloy matrix resulting from workpiece 14 formation, solution heat treatment and quenching, cause crystallographic lattice distortion and associated dislocation sites in workpiece 14. To maximize benefit from the various precipitation phases and distortions of the lattice, stretching procedures of block 24 should be accomplished within 8 hours of block 22 solution heat treatment.

While no improvement in resultant characteristics has been noted for rapid processing, a decay in final parameters may occur where stretching has been delayed beyond 8 hours of solution heat treatment. No quantification of this decay in performance has been made and even extended delays have produced characteristic enhancement, although to lower levels, but a maximum of 8 hours between solution heat treatment and stretching in autoclave 16 is required for optimal characteristic enhancement.

When workpiece 14 has been stretched to final dimensions through operations in block 24, it is aged for a period of from 8 to 24 hours at a temperature of 325° to 375° F. to assure optimization of microscopic metallurgical structure.

Aging, in block 26, is accomplished either in the autoclave or in a storage area.

Enhancement of physical properties of parts not processed in the sequence of the preferred embodiment has also been demonstrated. For near-net parts not solution heat treated directly after superplastic formations, reheating to their superplastic formation temperature, without the formation pressures and die or mold application of forming, and thereafter solution heat treating and stretching them to final dimensions of die 12 in autoclave 16, with controlled aging, also provides property enhancement, although quantification of differences has not been made.

What is claimed is:

1. A process for enhancement of physical properties of an Aluminum-Lithium alloy workpiece, comprising the steps of:

(*a*) securing first and second shaping means, said first shaping means configured to form a near-net part and said second shaping means comprising female die means configured to final dimensions of said workpiece;

(*b*) fabricating a preform of said workpiece by conventional superplastic forming procedures through heating a blank of Al-Li alloy to its superplastic temperature and shaping the same to the subscale dimensions of said first shaping means;

(c) removing said preform from said first shaping means and immersing it in a suitable quenching medium;

(d) placing said preform into said second shaping means establishing a pressure tight seal between said preform and said second shaping means;

(e) installing said preform and second shaping means into autoclave means;

(f) heating said preform within said autoclave means to an elevated temperature;

(g) applying high pressure to said preform in said second shaping means to cause it to stretch to conformity with a forming cavity of final workpiece dimensions in said second shaping means;

(h) removing said high pressure and allowing said preform to age for a specified period.

2. The process of claim 1 wherein said Aluminum-Lithium alloy includes traces of other metals.

3. The process of claim 2 wherein said other metals are from a group consisting of copper and magnesium.

4. The process of claim 1 wherein said superplastic formation temperature is within the range of 950 to 1050 degrees F.

5. The process of claim 1 wherein dimensions of said die of final dimensions are uniformly greater than those of said first shaping means by a fixed factor of between 2 and 10 percent.

6. The process of claim 1 wherein said first shaping means comprises a male mold.

7. The process of claim 1 wherein said quench medium is a liquid.

8. The process of claim 7 wherein the liquid is one selected from the group consisting of water and glycol.

9. The process of claim 1 wherein the workpiece formed by said first shaping means is smaller in each dimension by a fixed percentage than the workpiece after application of high pressure.

10. The process of claim 9 wherein said percentage is in the range of 2 to 10 percent.

11. The process of claim 1 wherein said elevated temperature is within the range of 325 to 375 degrees F.

12. The process of claim 1 wherein said specified period of aging is between 8 and 24 hours.

13. The process of claim 1 wherein said workpiece is aged at said specified temperature at atmospheric pressure.

14. The process of claim 1 wherein said workpiece is aged at said specified temperature for at least a portion of said specified period, in said autoclave means.

15. A process for enhancement of physical properties of an Aluminum-Lithium alloy workpiece comprising the steps of:

securing a near-net workpiece made from Aluminum-Lithium alloy;

heating said workpiece to its superplastic temperature;

solution heat treating said heated workpiece through immersion in a quenching medium;

sealing said quenched workpiece to a die of final dimensions;

placing said sealed workpiece and die in an autoclave;

heating said autoclave to an elevated temperature;

applying high pressure across said workpiece and die;

allowing said workpiece to age at said elevated temperature for a specified period.

16. The process of claim 15 wherein said Aluminum-Lithium alloy includes traces of other metals.

17. The process of claim 16 wherein said other metals are from a group consisting of copper and magnesium.

18. The process of claim 15 wherein said superplastic formation temperature is within the range of 950 to 1050 degrees F.

19. The process of claim 15 wherein dimensions of said die of final dimensions are uniformly greater than those of said first shaping means by a fixed factor of between 2 and 10 percent.

20. The process of claim 15 wherein said quench medium is a liquid.

21. The process of claim 7 wherein the liquid is one selected from the group consisting of water and glycol.

22. The process of claim 15 wherein said elevated temperature is within the range of 325 to 375 degrees F.

23. The process of claim 15 wherein said specified period of aging is between 8 and 24 hours.

24. The process of claim 15 wherein said workpiece is aged at said specified temperature at atmospheric pressure.

25. The process of claim 15 wherein said workpiece is aged at said specified temperature for at least a portion of said specified period, in said autoclave means.

* * * * *